US006422552B1

(12) United States Patent
Chesno et al.

(10) Patent No.: US 6,422,552 B1
(45) Date of Patent: Jul. 23, 2002

(54) MOVABLE FOLDERS AND FORMER BOARD ARRANGEMENT

(75) Inventors: Lewis Bradley Chesno, Brentwood; Charles Henry Dufour, Durham; Robert Michael Riotto, Somersworth, all of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/456,852

(22) Filed: Dec. 8, 1999

Related U.S. Application Data

(63) Continuation-in-part of application No. 09/361,388, filed on Jul. 26, 1999, now Pat. No. 6,152,034.

(51) Int. Cl.[7] ..... B41F 13/56

(52) U.S. Cl. ..... 270/32; 270/41; 101/225; 101/483; 493/477; 493/478

(58) Field of Search ..... 101/212, 215, 101/216, 225, 226, 227; 270/6, 10, 21.1, 41, 32; 493/477, 478

(56) References Cited

U.S. PATENT DOCUMENTS

| | | | | | |
|---|---|---|---|---|---|
| 3,650,216 | A | * | 3/1972 | Harwick et al. | 104/166 |
| 3,942,782 | A | | 3/1976 | Hermach | 270/6 |
| 3,994,485 | A | * | 11/1976 | Weir | 270/30.11 |
| 4,494,740 | A | * | 1/1985 | Noboru et al. | 493/408 |
| 4,564,470 | A | * | 1/1986 | Schmitt | 270/21.1 |
| 5,154,022 | A | * | 10/1992 | Chalco et al. | 51/281 R |
| 5,303,909 | A | * | 4/1994 | Maylaender | 270/5 |
| 5,309,834 | A | | 5/1994 | Koch | 101/248 |
| 5,676,056 | A | | 10/1997 | Stein et al. | 101/226 |
| 5,775,222 | A | * | 7/1998 | Zweifel et al. | 101/227 |
| 6,024,684 | A | | 2/2000 | Maylaender et al. | 493/346 |
| 6,128,522 | A | * | 10/2000 | Acker et al. | 600/411 |
| 6,152,034 | A | * | 11/2000 | Dufour | 101/225 |
| 6,298,781 | B1 | * | 10/2001 | Dufour | 101/483 |

FOREIGN PATENT DOCUMENTS

| | | |
|---|---|---|
| DE | 554955 | 12/1929 |
| DE | 1960565 | 6/1971 |
| DE | 2510057 | 9/1975 |
| EP | 0529552 | 3/1993 |
| EP | 1072551 | 1/2001 |
| FR | 686001 | * 12/1929 |
| GB | 1325024 | 8/1973 |
| GB | 1490675 | 11/1977 |
| WO | 9717200 | 5/1997 |

* cited by examiner

*Primary Examiner*—Christopher P. Ellis
*Assistant Examiner*—Patrick Mackey
(74) *Attorney, Agent, or Firm*—Davidson, Davidson & Kappel, LLC

(57) ABSTRACT

A movable folder assembly includes one or more folders slidingly supported on a pair of rails and an actuator for moving the folder on said pair of rails. The actuator may include a hydraulic cylinder and a control unit for controlling said hydraulic cylinder. The folder(s) is supported on said rails by bearings. Preferably, the bearings are linear bearings, and most preferably, the folder(s) is supported on at least one of said rails by dual-type linear bearings. The folder(s) may be used in conduction with a former board arrangement in a web-fed rotary newspaper printing press which includes a first and a second row of former boards each row including a first, second and third former board for longitudinally folding one or more ribbons passing over the former boards. The first row of former boards is arranged above the second former board, and a movable folder is located below one of the former boards of the second row of former boards for crossfolding and cutting the ribbons into signatures.

20 Claims, 11 Drawing Sheets

Severity index = 30

Severity index = 30

Severity index = 26,5

Severity index = 26,5

MOVABLE FOLDERS AND FORMER BOARD ARRANGEMENT

This application is a continuation in part of U.S. application Ser. No. 09/361,388, filed Jul. 26, 1999, now U.S. Pat. No. 6,152,034 and entitled FORMER BOARD ARRANGEMENT IN A WEB FED ROTARY NEWSPAPER PRINTING PRESS, the entire disclosure of which is hereby incorporated by reference.

FIELD OF THE INVENTION

The present invention is related to a web-fed rotary printing press. In particular, the invention is related to movable folders and a former board arrangement for folding a plurality of printed ribbons in a web-fed rotary printing press.

BACKGROUND INFORMATION

In the production of newspapers, a plurality of paper webs is usually fed through an associated number of printing units to be printed on either one side or on both sides with a desired single or multi-color image. The printed webs are afterwards longitudinally cut into ribbons which are fed to a former board section including one or more former boards for applying a longitudinal fold to the ribbons. Before passing over the former boards, the ribbons are usually superposed by means of guide rollers before entering the former section and after exiting the former section, in order to obtain a desired paging and desired sectioning of the final newspaper.

After exiting the former board section, the superposed and longitudinally folded ribbons are then again superposed and fed to a downstream folder, in which the longitudinally folded superposed ribbons are cut and then folded crosswise into single signatures which are transported to a mailroom section, in which the final newspapers are gathered, stacked and collated for further shipment.

From the prior art, it is known to use former board sections in which three pairs of former boards are arranged above each other and the superposed and longitudinally folded ribbons are fed to a subsequent folder which is fixedly installed in the press room. The feeding of the folded and superposed ribbons to the folder is achieved by means of a plurality of guide rollers which are located below each of the former boards and around which each of the longitudinally folded superposed ribbons is passed.

Due to the so-called radius effect, which is caused by the outer ribbon of a multi-layered ribbon passing over a diverting roller having a greater distance from the center of rotation of the roller compared with the inner ribbon of the multi-layered ribbon, there is a certain likeliness of the occurrence of wrinkles and other defects of the printed ribbons which directly affect the printed image and general appearance of the newspapers. Moreover, there is also the danger of gussets or even tears of the ribbons or the occurrence of tension variation or a ribbon weave which also detrimentally affect print quality. Another problem arising when passing a plurality of printed ribbons over a diverting roll is that there may occur a marking of the freshly printed ink or a misregistration in the so-called cut-off register which actually defines the position at which the ribbons are cut crosswise in the folder section, in order to obtain a properly cut newspaper.

The main performance parameters which influence the probability of an occurrence of the above-described print affects are the paging of the newspapers, the diameter of the guide rollers, the angle of wrap of the ribbons around the guide rollers, the length of the section leads, the number of the gathered sections and the gains of the nip rollers for pulling the ribbons over the former boards, which are located below each of the former boards and the ability of the nip rollers to hold the papers.

One of the main problems which arises during the operation of the printing press is that severe wrinkles which are likely to fold over or tear, do not only produce visible print affects, but may also result in folder jams which inevitably lead to a shut-down of the printing press for a longer period of time, and therefore to a loss in output.

U.S. Pat. No. 5,775,222 purports to disclose a rotary printing press which includes folders which are movable via a yoke. One of the folders may be used as a primary folder, with the other folder being available as a replacement. UK 1,490,675 purports to discribe a method of interchanging folders in a printing machine, comprising lowering a folder to be removed from its operating position, moving the folder to be removed generally horizontally so as to remove it from the lowered position, moving the folder to be installed generally horizontally to be lowered position, and raising the folder to the installed to its operating position.

SUMMARY OF THE INVENTION

Having outlined the state of the art and its attendant disadvantages, it is an object of the present invention to provide for a folder arrangement in a web-fed rotary newspaper printing press, which reduces the risk of the occurrence of severe wrinkles in the images of the printed ribbons.

In accordance with a first embodiment of the present invention, a former board arrangement in a web-fed rotary newspaper printing press comprises a first and a second row of former boards, each row including a first, a second and a third former board for longitudinally folding one or more ribbons passing over the former boards. The first row of former boards is arranged preferably obliquely above the second row of former boards, and a movable folder to which the longitudinally folded webs are fed after exiting the former boards of the first and second row of former boards, is located below one of the former boards.

The combination of two rows of three former boards and a movable folder which may be located below any of the three former boards of the second row of former boards, reduces the likeliness of the occurrence of printed defects such as wrinkles and gussets, tares, tension variations, ribbons weave and marking, significantly.

Moreover, it was found that the variations in the print-to-cut register of the printed signatures in the subsequent folder section are also reduced by the former board arrangement according to the present invention.

According to another aspect of the present invention, a plurality of guide rollers or gathering rollers is provided preferably below each former board, in order to divert the longitudinally folded ribbons exiting the former boards to the movable folder, whereby all of the folded ribbons are preferably superposed by means of the guide rollers before entering the folder.

According to another aspect of the present invention, a plurality of superposed ribbons is passing over each of the former boards of the first and second rows of former boards, whereby the total number of superposed ribbons running over the former boards of the second row of former boards is preferably larger than the number of ribbons passing over the former boards of the first row of former boards.

The advantage which can be obtained by using a different number of superposed ribbons running over each of the former boards lies in the increase in the variety of different sections and the paging of the newspaper, as four ribbons or half-webs usually make up one section of the newspaper. By varying the number of ribbons passing over each former board, a desired arrangement of the sections in the newspaper can be obtained with a much higher flexibility. In this respect, it has also been found that it is advantageous if the total number of superposed ribbons passing over the former boards of the second row of former boards is larger than the number of ribbons passing over the first row of former boards, as the severity of the wrinkles and gussets and therefore the probability of print defects is being reduced.

According to another aspect of the present invention, a different number of superposed ribbons is passing over at least two of the former boards of the first row of former boards or of the second row of former boards, whereby in case of the first row of former boards, two superposed ribbons may pass over two of the former boards of the first row of former boards. In this embodiment, the former board having the largest number of ribbons is preferably located on the very outside of the first row of former boards.

In particular, it has shown to be advantageous if two superposed ribbons are passing over two of the former boards of the first row of former boards, and four superposed ribbons are passing over the remaining former board of the first row of former boards. A further reduction of the severity of wrinkles and gussets may be obtained if the two former boards which are folding two of the superposed ribbons each, are located side-by side and the remaining former board folding four superposed ribbons simultaneously is located at the very outside of the first row of former boards.

According to another aspect of the present invention, a different number of superposed ribbons is passing over at least two of the former boards of the second row of former boards. In this embodiment of the invention, the folding apparatus is preferably located below the former board of the second row of former boards which folds the largest number of superposed ribbons, so that these ribbons are directly fed into the folder without running over guide rollers before entering the folder.

In accordance with another embodiment of the present invention, a movable folder is employed, which significantly simplifies the process of changing the path of the folded ribbons, by allowing the folder to easily move below the former board folding the largest number of ribbons.

According to another embodiment of the present invention, preferably four superposed ribbons are passing over two of the former boards of the second row of former boards, and eight superposed ribbons are passing over the remaining former board of the second row of former boards. In this embodiment, the two former boards for folding four superposed ribbons each are preferably located side by side, and the former board folding eight superposed ribbons is accordingly located at the very outside of the second row of-former boards, preferably directly above the movable folder.

According to another embodiment of the present invention, the former boards of the first row of former boards are located substantially inline with the former boards of the second row of former boards, so that e. g. the tips of the former boards of each row are arranged in substantially vertical planes running through the former boards.

According to another embodiment of the present invention, the former boards of the first and second row of former boards may also be located offset to each other, preferably such that the tips of the former boards of the first row of former boards are located in substantially vertical planes which run between two adjacent former boards of the second row of former boards. By means of this tagged arrangement, the number of guide rollers for directing the superposed ribbons exiting the former boards of the first row of former boards, and therefore the likeliness for the occurrence of wrinkles and gussets can be further reduced.

In accordance with another embodiment of the present invention, a movable folder assembly includes a folder slidingly supported on a pair of rails and an actuator for moving the folder on said pair of rails.

The actuator preferably includes a hydraulic cylinder and a control unit for controlling said hydraulic cylinder. Preferably, the cylinder rod of the hydraulic cylinder is rigidly fixed to the platform and the body of the hydraulic cylinder is secured to the folder. Moreover, the hydraulic cylinder is preferably configured so that the cylinder body is the movable piece. In a preferred embodiment, this is accomplished by forming a bore through the length of the cylinder rod, and attaching the hose to the end of the rod. In this manner the hoses remain stationary as the folder is moved. This simplifies the layout of hydraulic hoses as compared with conventional hydraulic cylinder arrangements in which the hydraulic hoses move back and forth as the cylinder moves.

The movable folder assembly may be employed in combination with the former board arrangement described above, or may be used with conventional former board arrangements. The use of a movable folder significantly reduces a time required to re-web the folder in the event of a folder failure because, by moving a replacement folder into the same position as the original folder, there is no need to reallign the webs to compensate for a change in folder position. In addition, when used in conjunction with the former board arrangements described above, the use of movable folders significantly simplifies the process of changing the path of the folded ribbons, by allowing the folder to easily move below the former board folding the largest number of ribbons.

In accordance with a further aspect of this embodiment, the folder is supported on said rails by bearings. Preferably, the bearings are linear bearings, and most preferably, the folder is supported on at least one of said rails by dual-type linear bearings. The use of linear bearings provides a number of advantages including improved load distribution, and a reduced susceptabilty to failure due to contaminants (e.g. dirt) in or on the bearings and/or rails.

The folder assembly may also include a preset device for providing a plurality of preset folders positions along the rails. Preferably, the preset device is an absolute encoder.

In accordance with a still further aspect of this embodiment of the present invention, the movable folder includes a first folder and a second folder slidingly supported on the pair of rails. In one embodiment, the first folder is secured to the second folder so that the first and second folders move together along the rails. In an alternative embodiment, the first and second folders move separately along the rails.

BRIEF DESCRIPTION OF THE DRAWINGS

Other objects and advantages of the present invention will become apparent to those skilled in the art from the following detailed description of preferred embodiments, when read in conjunction with the accompanying drawings, wherein like-elements have been designated with like-reference numerals and wherein.

DETAILED DESCRIPTION OF THE REFERRED EMBODIMENTS

Figure 1:
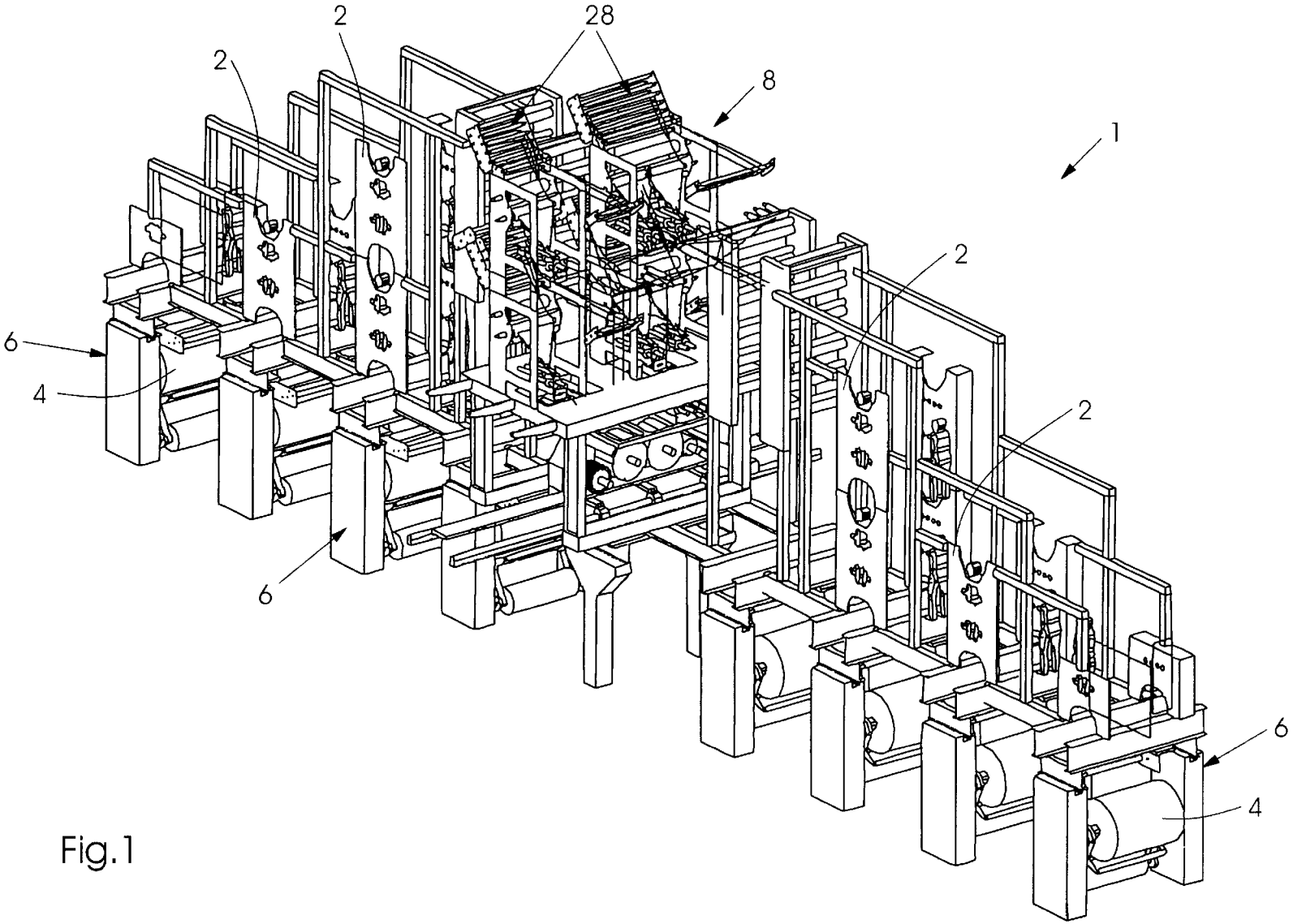
FIG. 1 is a schematic view of an exemplary embodiment of a newspaper printing press according to the present invention.

As it is shown in FIG. 1, a newspaper printing press 1, e g. a lithographic web-fed rotary printing press, comprises a plurality of printing units 2 for printing a single or a multi-color image on a variety of webs 4 which are supplied by reel stands 6. The reel stands 6 are preferably located in the basement of a press room. After the printing operation in the printing unit 2, the webs 4 are fed to a former board arrangement 8 according to the present invention, which is preferably located in the center of the newspaper printing press 1, but may also be located at one side of the press or at an end portion thereof.

Figure 2:
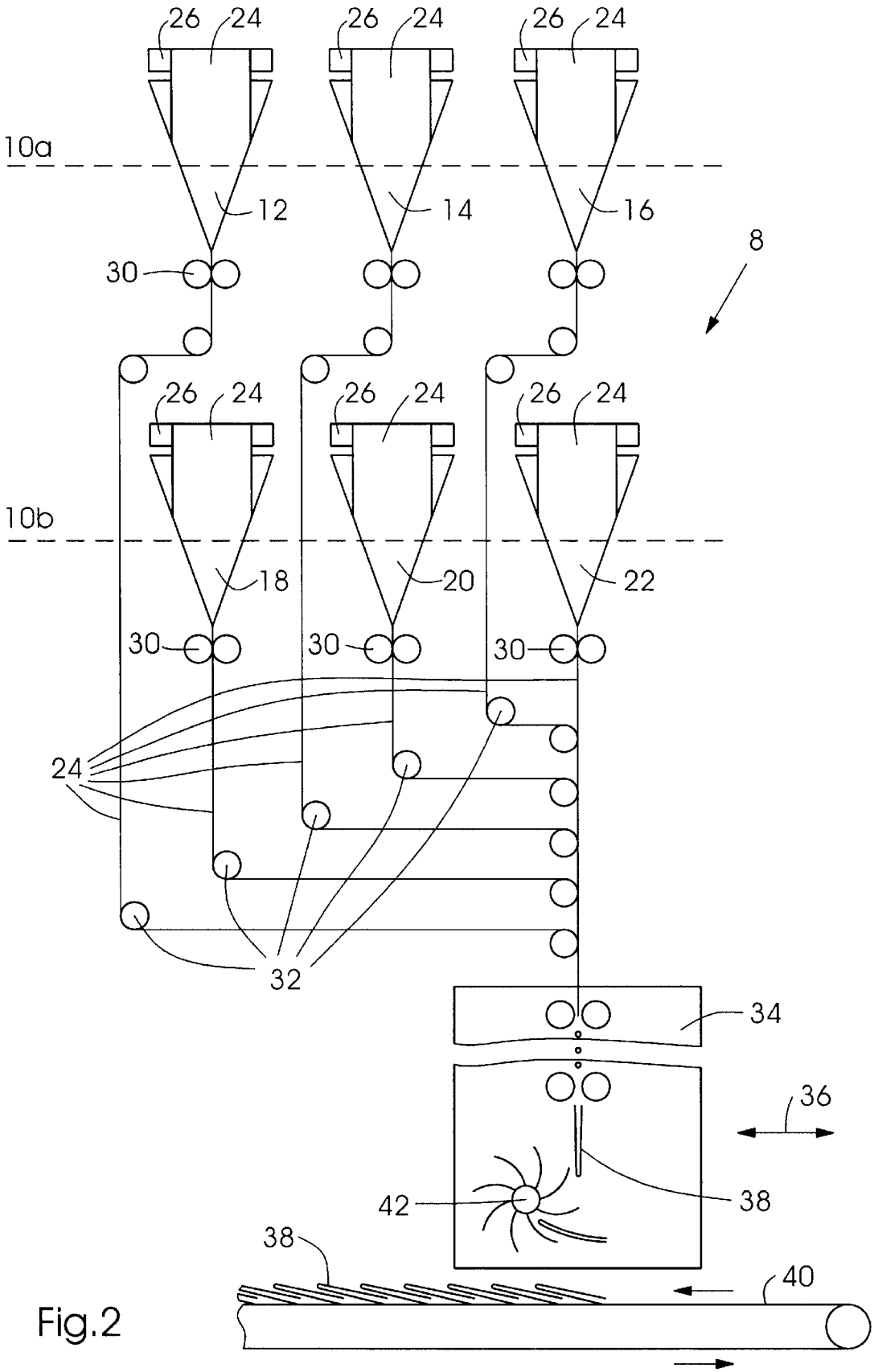
FIG. 2 is a more detailed schematic view of the former board arrangement according to the present invention with two rows of three former boards, guide rollers and a schematic view of a movable folder.

The former board arrangement 8 of the present invention which is shown in more detail in FIG. 2, includes a first row 10*a* of three former boards 12, 14, 16 and a second row 10*b* of three further former boards 18, 20 and 22.

After the printing operation in the printing units 2, and before entering the former board arrangement 8, the webs 4 are preferably longitudinally cut into single ribbons or half webs 24, which are then fed to the former boards 12, 14, 16 and 18, 20, 22 of the first and second row 10*a* and 10*b* of the former boards via rollers 26 located on top of each former board 12, 14, 16, 18, 20, 22.

According to an exemplary embodiment of the invention, a plurality of ribbons 24 may be arranged on top of each other before feeding them to the former boards 12 to 22, whereby four ribbons or half webs 24 usually make up one section of a newspaper. The superposition of the ribbons 24 may be achieved by known gathering or take-off rollers 28, as they are indicated in FIG. 1.

After passing the former boards 12 to 22, the multi-layer or superposed ribbons 24 are fed to a pair of nip rollers 30 which apply a longitudinal fold to the superposed ribbons 24. After passing the nip rollers 30, the longitudinal folded superposed ribbons are passed over a plurality of guide rollers 32 which guide the ribbons 24 towards a folder 34. The folder 34 is movable relative to the former boards 12 to 22, as it is indicated by arrow 36 in FIG. 2. The folder 34 may be a conventional folder which cuts the superposed ribbons 24 entering the folder 34 into a plurality of newspapers 38, which may afterwards be folded crosswise and located on a conveyor belt 40 by a known fan wheel arrangement 42. The conveyor belt 40 transports the papers 38 as a shingled stream of papers 38 to a further processing section (not shown), e. g. a mailroom.

A number of different configurations for passing the ribbons 24 over the former boards 12 to 22 will now be discussed with respect to FIGS. 3 through 8.

Figure 3:
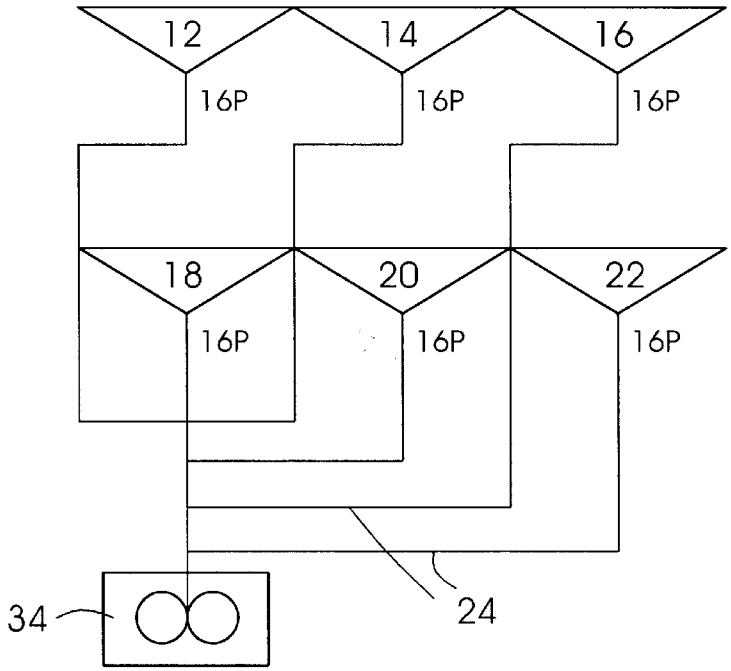
FIG. 3 is a schematic view of the former board arrangement of FIG. 2 which is set up in a first configuration.
Figure 4:
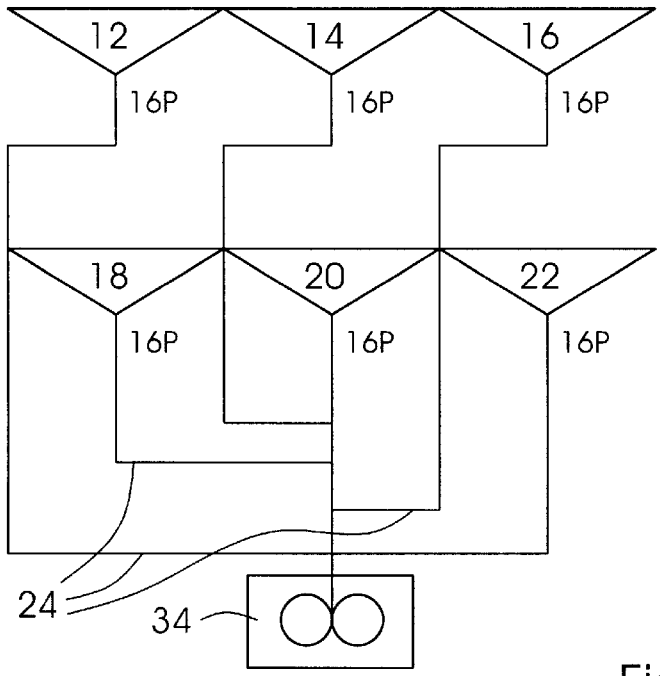
FIG. 4 is the former board arrangement of FIG. 2, which is set up in a second configuration.
Figure 5:
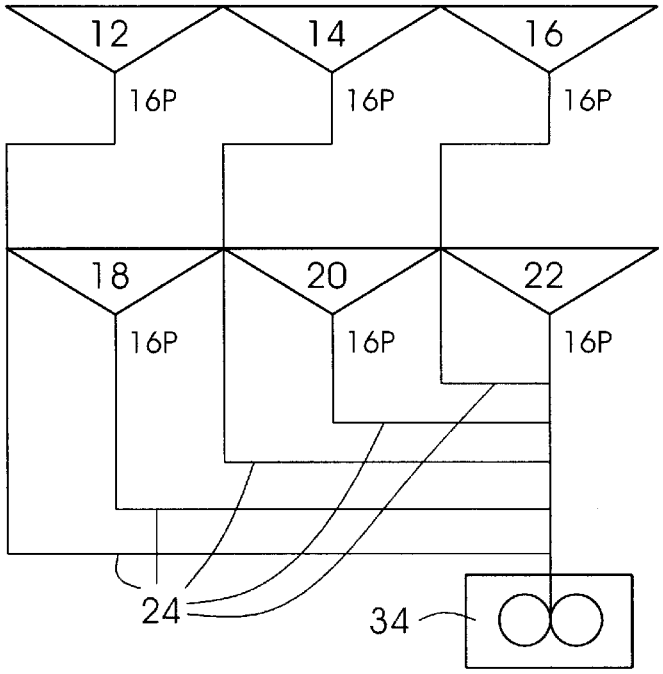
FIG. 5 is the former board arrangement of FIG. 2, which is set up in a third configuration.

FIGS. 3 to 5 show a first, second and third configuration, in which 16 pages, i.e. four superposed ribbons 24 each printed on both sides, are passed over each of the former boards 12 to 22 of the first and second row 10*a*, 10*b* of former boards. Depending on the position of the folder 34, the likeliness of the occurrence of wrinkles and gussets of each configuration is given by a severity index, which amounts to 30 in case of the configurations of FIGS. 3 and 4. In the configuration of FIG. 5, however, the severity index is reduced to 26.5, as applicant has found, which may be a result of the configuration of guide rollers and the successive superposition of webs 24 one by one from only one side and the straight feeding into the folder 34.

Figure 6:
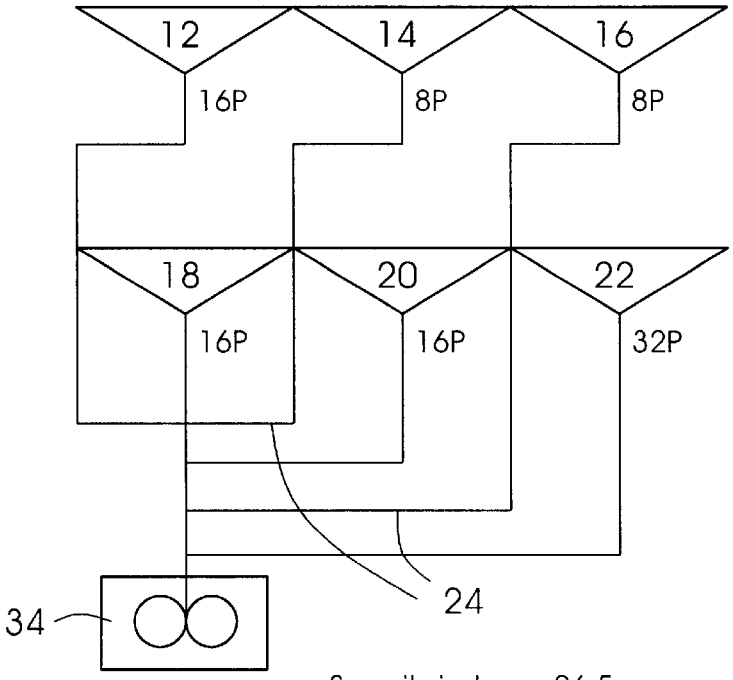
FIG. 6 is the former board arrangement of FIG. 2, which is set up in a fourth configuration.
Figure 7:
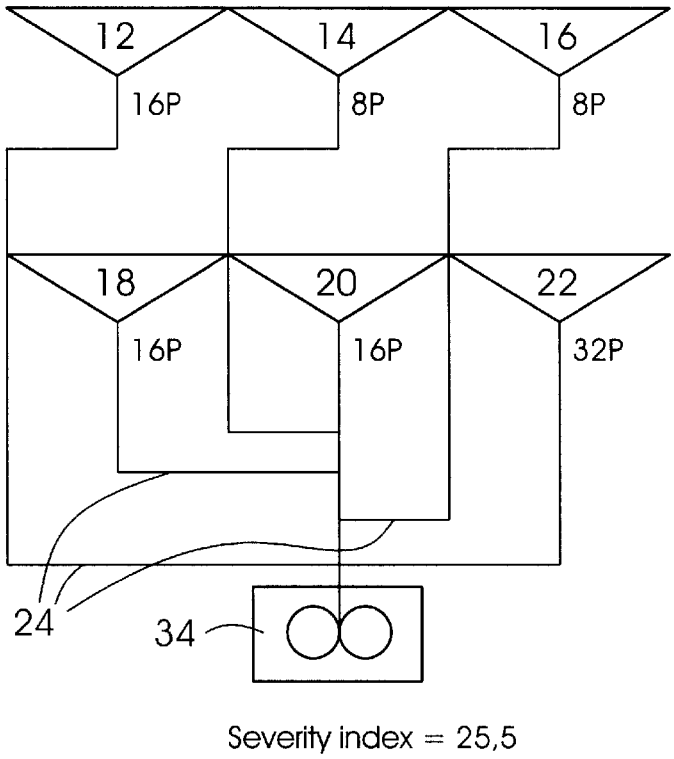
FIG. 7 is the former board arrangement of FIG. 2, which is set up in a fifth configuration.
Figure 8:
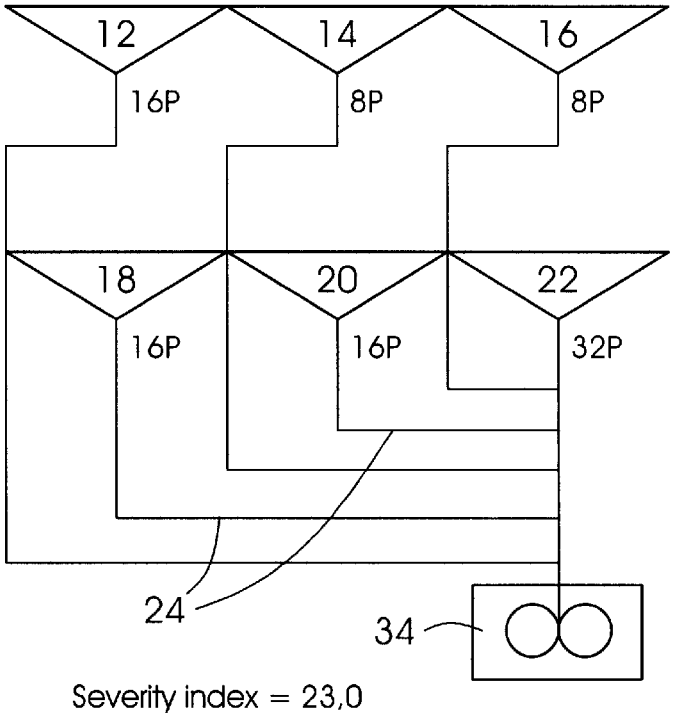
FIG. 8 is the former board arrangement of FIG. 2, which is set up in sixth configuration according to the preferred embodiment of the invention.

Turning to the fourth, fifth and sixth configuration of FIGS. 6, 7 and 8, in which the same total number of ribbons 24 is fed to the folder 34, but in which due to a different paging of the newspaper, eight pages are fed over former boards 14 and 16 of the first row 10*a* of former boards and 32 pages, i. e. eight sections are passing over former board 22 of the second row 10*b* of former boards, the severity index is reduced from 26.5 for the FIG. 6 configuration to 25.5 for the FIG. 7 configuration and further down to 23.0 for the FIG. 8 configuration. As indicated above, the reduction of the severity index may be caused by the different positions of the folder 34 changing from the very left in FIG. 6 to superposition of the folded superposed the very right in FIG. 8 and by the successive ribbons below the former board 22 in FIG. 8, starting from only one (the left) side.

However, there may be other reasons for the reduction of the severity index in case of FIG. 8 configuration, such as the straight feeding of the heaviest section (32 pages) running straight into the folder 34.

Figure 9:
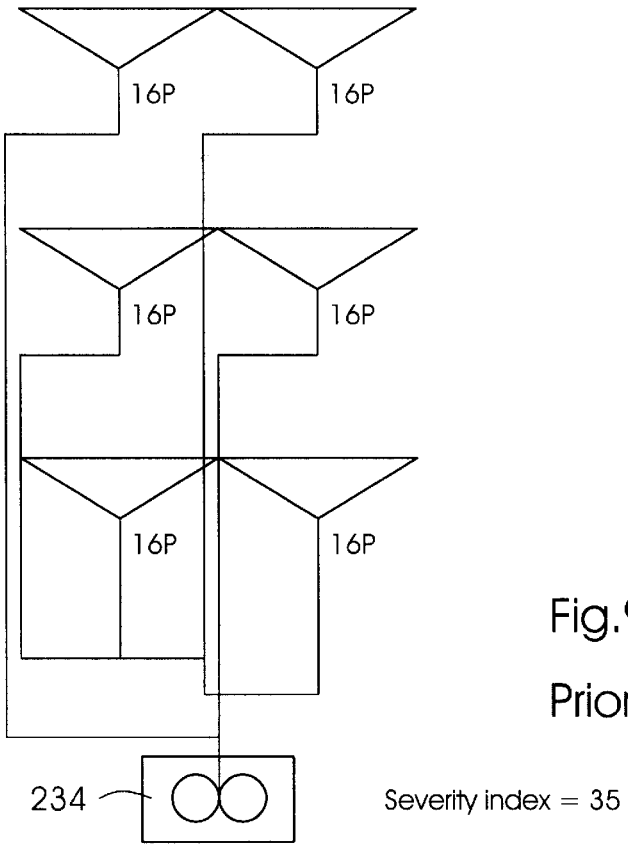
Fig.9 Prior Art
FIG. 9 and FIG. 10 are prior art former board arrangements which are set up in two exemplary configurations.
Figure 10:
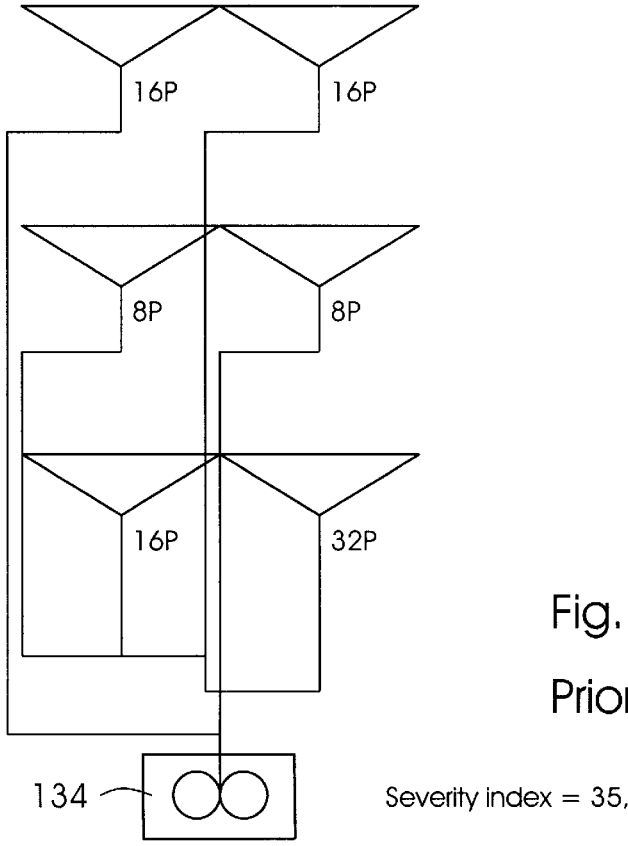
Fig.10 Prior Art

In comparison, in the prior art devices (FIGS. 9 and 10) having a non-movable or fixed folder 134, the severity indexes amount to 35 for FIG. 9 and 35.5 for FIG. 10, although the total number or ribbons fed to the folder 134 is the same as the configurations using a former board arrangement 8 according to the present invention shown in FIGS. 3 to FIG. 8.

Moreover, sliding folders allow an easy replacement of a folder or the introduction of a spare folder on a long press with more than one folder position. Preferably, the folders slide on rails. Moreover, movement of the folders may be actuated, for example, with hydraulic or motor actuators. In addition, in order to improve ribbon handling performance, the folders may be moved while the press is running.

As a person skilled in the art will recognize, the severity indexes for the different configurations of FIGS. 3 to 8 of the former board arrangement 8 according to the present invention are always lower than the severity index of the prior art former board arrangement, shown in FIGS. 9 and 10.

It will be appreciated by those skilled in the art that the present invention can be embodied in other specific forms without departing from the spirit or essential characteristics thereof, and that the invention is not limited to the specific embodiments described therein, in particular to the number of configurations shown in FIGS. 3 to 8. Accordingly, other configurations, e.g. a staggered arrangement of the first row of former board 10*a* relative to the second row of former board 10*b* or a certain offset of two adjacent former boards in each row may be conceivable, which may lead to an even further reduction of the severity index. Moreover, the number of ribbons 24 passing over the former boards 12 to 22 may also be varied in any possible and conceivable way, in order to obtain a desired paging and sectioning of the newspaper.

According to a further embodiment of the invention, two rows of former boards with three former boards each arranged above each other may be combined with two folders plus independently driven former rollers and nip rollers associated with the former boards, in order to allow each former board to feed either of the two folders. In this embodiment, two printing jobs may be run independently, i.e. in order to start and to stop for different run lengths, which is ideal for allowing more additions of shorter run lengths.

Figure 11:
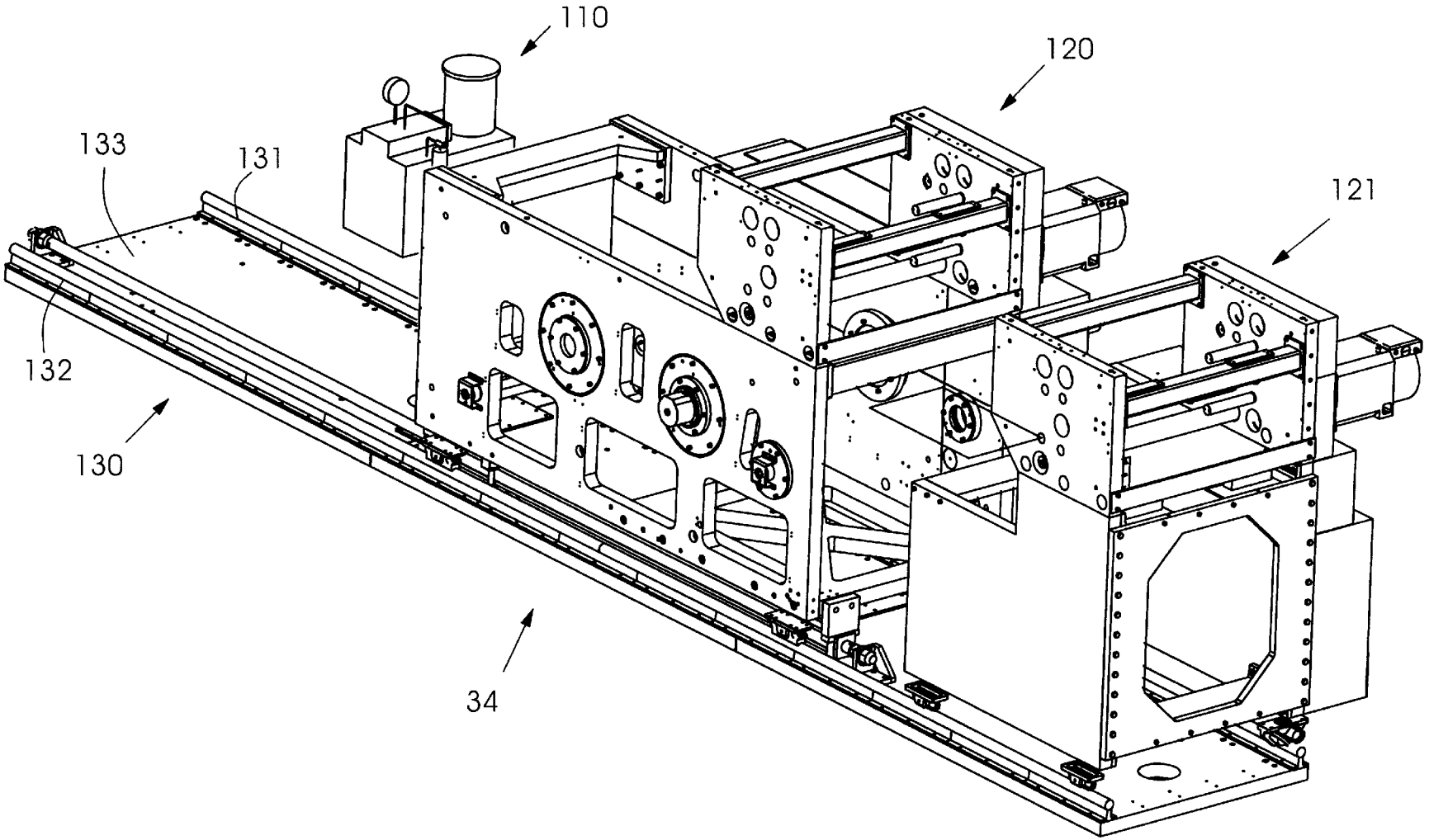
FIG. 11 shows a movable folder assembly in accordance with a preferred embodiment of the present invention.

A preferred embodiment of the movable folder 34 is shown in FIGS. 11 through 15. FIG. 11 shows a movable folder assembly 34 in accordance with a preferred embodiment of the present invention. The assembly 34 includes a first folder 120, a second folder 121, a hydraulic power unit 110 and a rail assembly 130. The first and second folders 120 and 121 and hydraulic power unit 110 may be of any known construction. Moreover, the first folder and the second folders may be of the same or different design. By way of example, the first folder 120 is illustrated in FIG. 11 as a JF 225 folder and the second folder 121 is illustrated as a RBS 32 folder, both of which are commercially available from Heidelberg Web Systems.

Figure 12:
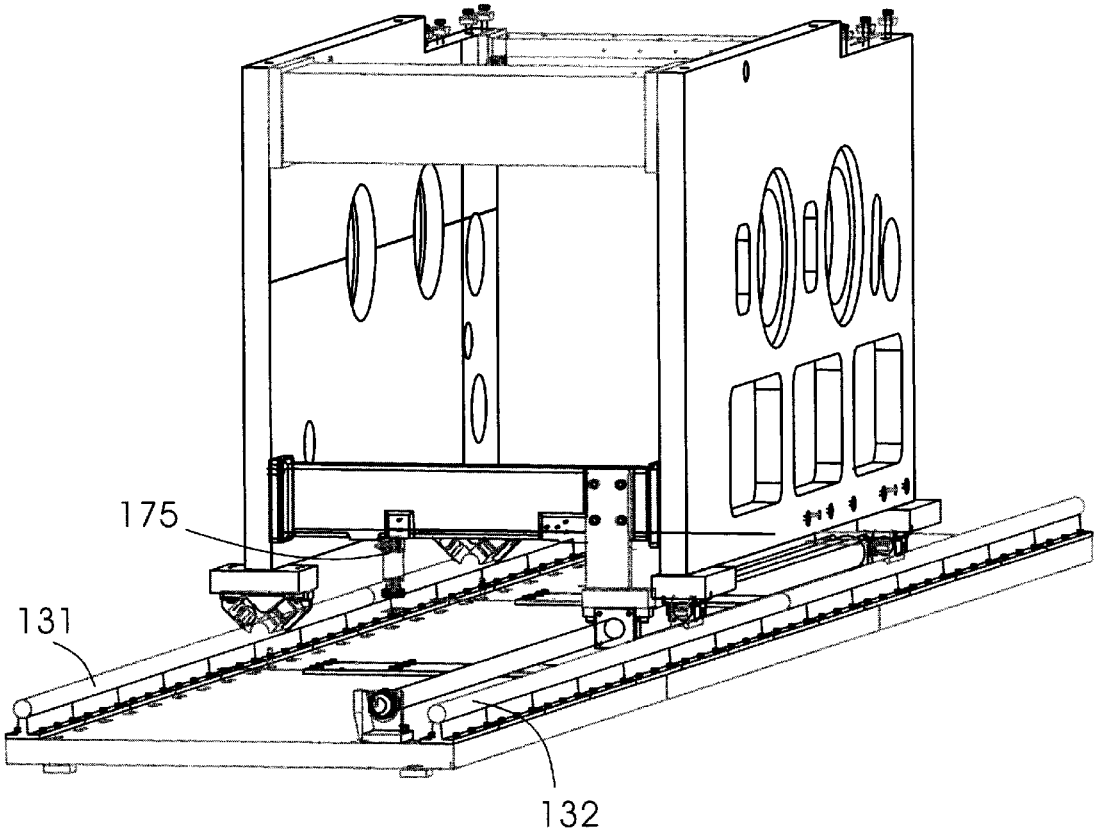
FIG. 12 shows a more detailed review of the folder and rail system of FIG. 11.
Figure 13:
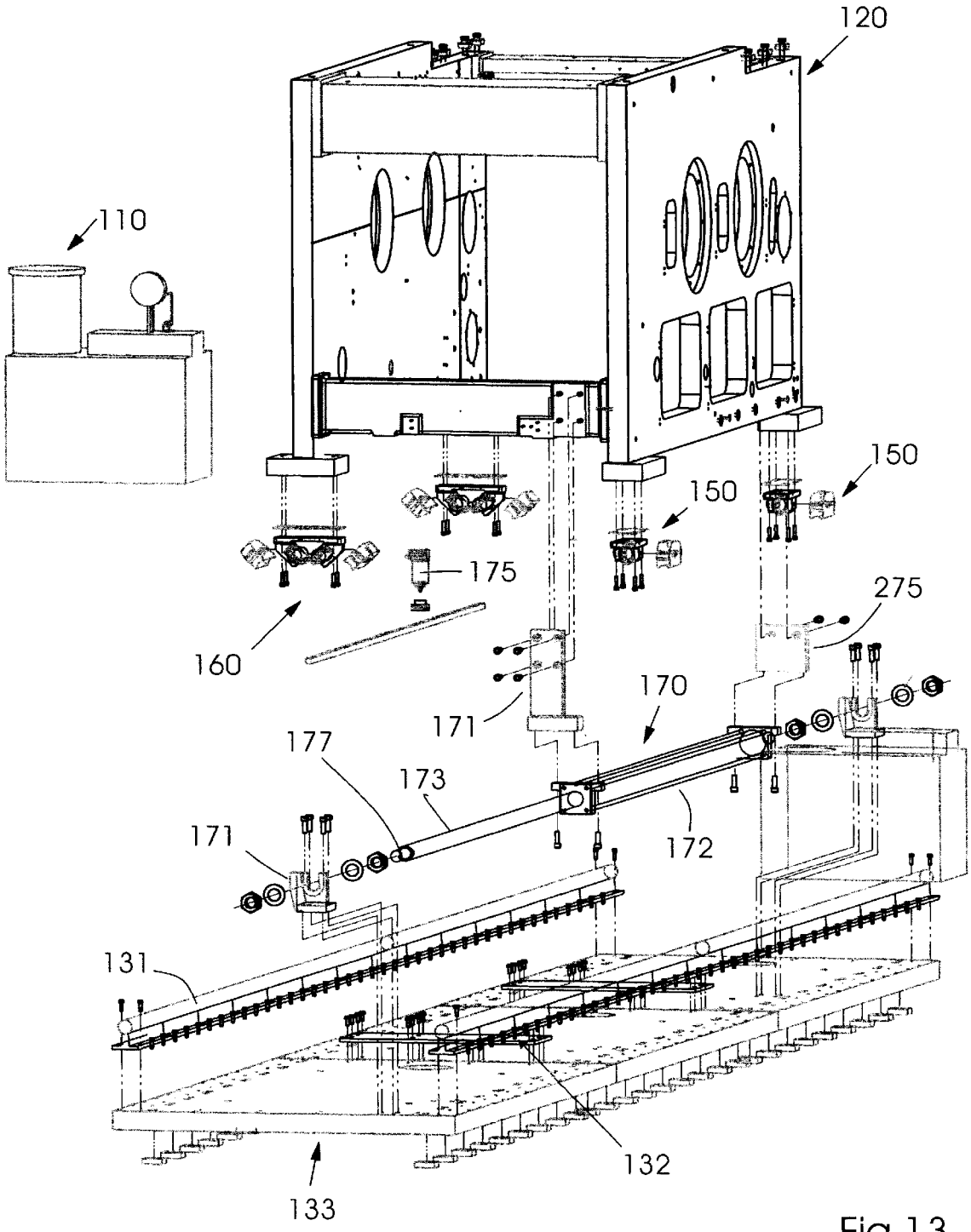
FIG. 13 shows an exploded view of folder and rail system of FIG. 12.

Rail assembly 130 includes parallel rails 131 and 132 secured to a support platform 133. Referring to FIGS. 12 and 13, first folder 120 is slidably mounted on rails 131 and 132 and respective bearing pairs 160 and 150. A hydraulic cylinder 170 is mounted on one end to support platform 133 via bracket 171 and on the other end to the folder 120. Although omitted for ease of illustration, folder 121 is also slidably mounted on rails 131 and 132 and respective bearing pairs 160 and 150, and is secured to folder 120 so that folders 120 and 121 move together along rails 131 and 132. Hydraulic power supply 110 is secured to folder 120. Folders 120 and 121 are movable on rails 131, 132 under the control of hydraulic cylinder 170 and power supply 110. The hydraulic cylinder 170 is controlled via an electronic controller resident in the power supply 110. Alternatively, the hydraulic cylinder can be activated via any controller known in the art and can be powered in any known manner. Preferably, the folder assembly 134 is configured to provide a plurality of preset folder positions along the rails 131, 132. In FIGS. 12 and 13, this preset function is implemented with an absolute encoder 175.

Referring to FIG. 13, hydraulic cylinder 170 includes a cylinder body 172 and a cylinder rod 173. The cylinder rod of the hydraulic cylinder is rigidly fixed to the platform via bracket 171 and the body 172 of the hydraulic cylinder 170 is secured to the folder via brackets 174, 275. During operation, the cylinder body 172 is the movable piece, while the rod 173 remains stationary. A bore is formed through the length of the cylinder rod 173, and a hydraulic hose (not shown) is connected to the end 177 of the rod 173. In this manner the hose remains stationary as the folder 120 is moved. This simplifies the layout of hydraulic hoses as compared with conventional hydraulic cylinder arrangements in which the hydraulic hoses move back and forth as the cylinder moves. In the preferred embodiment shown, the hydraulic cylinder is also used to lock and hold the folder(s) in position so that no other mechanism is required to maintain the folder(s) in a fixed position.

Figure 14A:
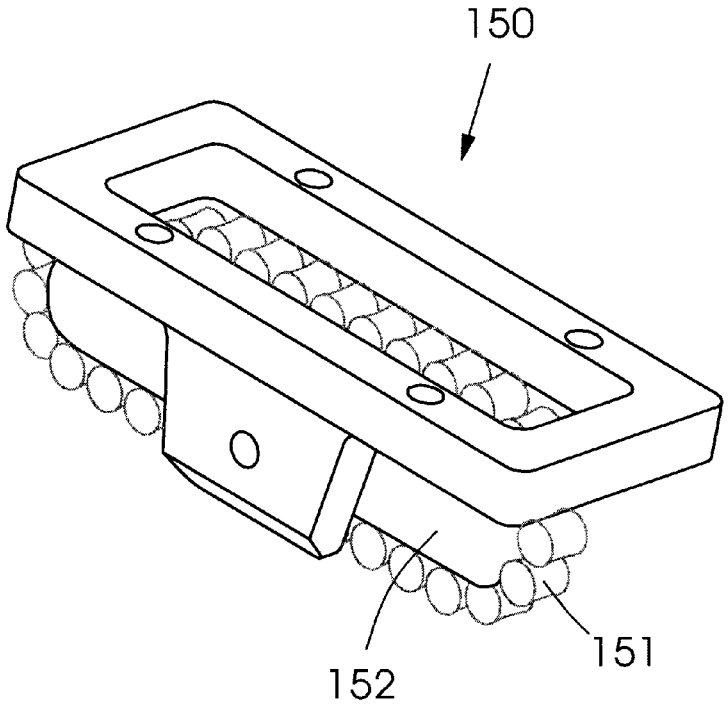
FIGS. 14*a* and 14*b* show a single-type linear bearing of FIG. 13.
Figure 14B:
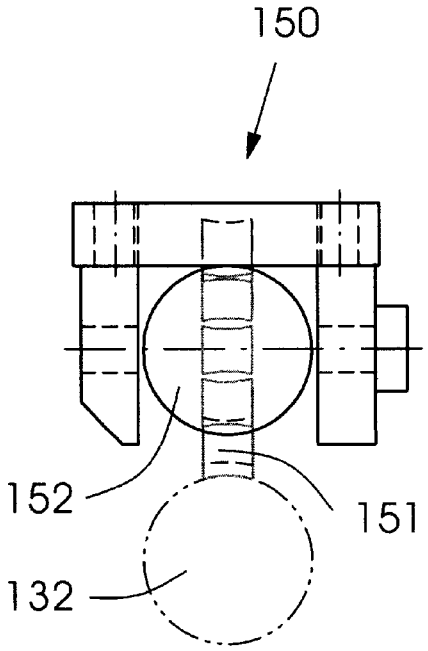

FIG. 14*a* illustrates a preferred bearing 150 in accordance with the present invention. Bearing 150 is a single-type linear bearing comprised of a plurality of bearings 151 which are rotatable about an eliptical track 152. As shown in FIG. 14*b*, the bearings 152 are in sliding contact with rail 132. Bearing 150 may, for example, be a Model RW32S-S bearing, commercially available from Thomson, Industries, Inc.

Figure 15A:
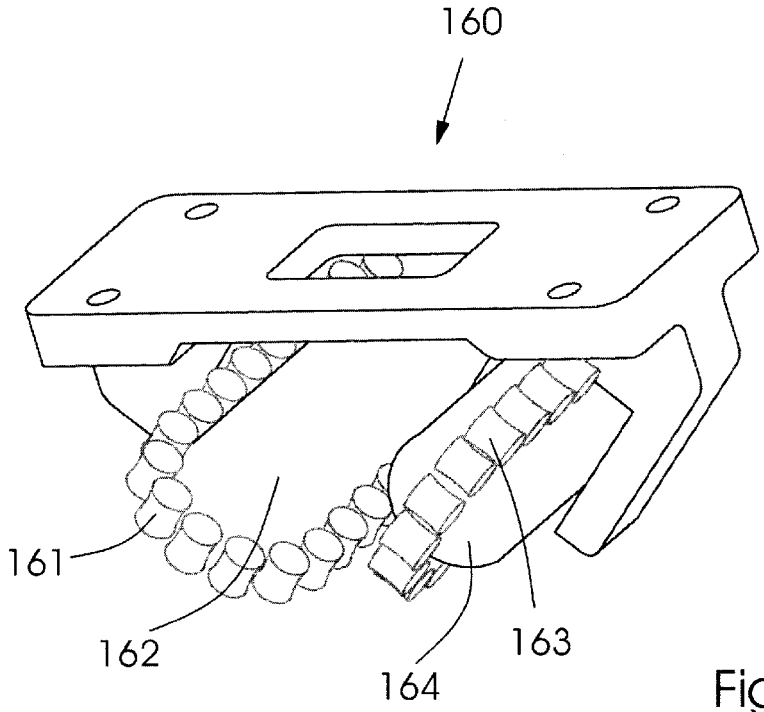
FIGS. 15*a* and 15*b* show a dual-type linear bearing of FIG. 13.
Figure 15B:
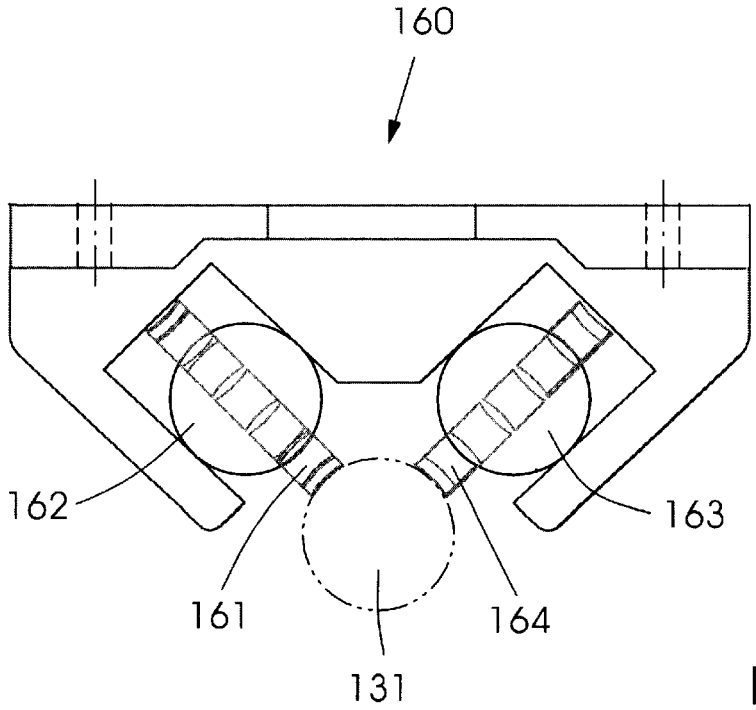

FIG. 15*a* illustrates a preferred bearing 160 in accordance with the present invention. Bearing 160 is a dual type linear bearing which includes a first plurality of bearings 161 which are rotatable about a first eliptical track 162 and a second plurality of bearings 163 which are rotatable about an second eliptical track 164, wherein tracks 162 and 164 are angularly offset form each other, and preferably are substantially perpendicular to each other. As shown in FIG. 15*b*, the bearings 161 and 163 are in sliding contact with rail 131. In addition, as the tracks 162 and 164 are angularly offset from each other, the bearing 160 prevents lateral (or side to side) movement of the folders 120 and 121. Bearing 16 may, for example, be a model RW 32 V-S bearing, commercially available from Thomson Industries, Inc.

The use of linear bearings provides a number of advantages including improved load distribution, and a reduced susceptabilty to failure due to contaminants (e.g. dirt) in or on the bearings and/or rails.

In accordance with a further embodiment of the present invention, folder 120 is not secured to folder 121. Rather, folders 120 and 121 each have respective hydraulic cylinders and hydraulic power and control units, and separately movable along the rails 131 and 132.

The scope of the invention is indicated by the appended claims rather than the foregoing description, and all changes that come within the meaning and range and equivalence thereof are intended to be embraced therein.

What is claimed is:

1. A movable folder assembly comprising:

a first folder and a second folder slidingly supported on a pair of rails;

an actuator for moving the first and second folders on said pair of rails; and a preset device for providing a plurality of preset folder positions along said pair of rails.

2. The movable folder assembly of claim 1, wherein said actuator comprises a hydraulic cylinder and a control unit for controlling said hydraulic cylinder.

3. The movable folder assembly of claim 1, wherein said first folder is secured to said second folder such that the first and second folders move together on said pair of rails.

4. The movable folder assembly of claim 1, wherein the first and second folders are separately movable on said pair of rails.

5. The movable folder assembly of claim 4, wherein said actuator includes a first actuator for the first folder and a second actuator for the second folder.

6. The movable folder assembly of claim 4, wherein said actuator includes a first hydraulic cylinder coupled to said first folder and a second hydraulic cylinder coupled to said second folder.

7. The movable folder assembly of claim 6, wherein said first and second hydraulic cylinders are coupled to one or more controllers for controlling said first and second hydraulic cylinders.

8. The movable folder assembly of claim 1, wherein said first and second folders are supported on said rails by bearings.

9. The movable folder assembly of claim 8, wherein said bearings are linear bearings.

10. The movable folder assembly of claim 9, wherein the first and second folders are supported on at least one of said rails by dual-type linear bearings.

11. The movable folder assembly of claim 9, wherein the first and second folders are supported on one of said rails by dual-type linear bearings and on the other one of said rails by single type linear bearings.

12. A movable folder assembly comprising:

a folder slidingly supported on a pair of rails;

an actuator for moving the folder on said pair of rails; and a preset device for providing a plurality of preset folder positions along said pair of rails.

13. The movable folder assembly of claim 12, wherein said actuator comprises a hydraulic cylinder and a control unit for controlling said hydraulic cylinder.

14. The movable folder assembly of claim 12, wherein said folder is supported on said rails by bearings.

15. The movable folder assembly of claim 14, wherein said bearings are linear bearings.

16. The movable folder assembly of claim 15, wherein the folder is supported on at least one of said rails by linear bearings.

17. The movable folder assembly of claim 10, wherein the folder is supported on one of said rails by dual linear bearings and on the other one of said rails by single linear bearings.

18. The movable folder assembly of claim 12, wherein the preset device is an absolute encoder.

19. A former board arrangement in a web-fed rotary printing press comprising:

a first row and a second row of former boards, each row including a first, second and third former board for longitudinally folding one or more ribbons passing over said former boards, said first row of former boards being arranged above said second row of former boards; and a movable folder, said movable folder being located below one of said former boards of said second row of former boards, said movable folder being slidingly supported on a pair of rails via linear bearings; and a preset device for providing a plurality of preset folder positions along said pair of rails.

20. The movable folder assembly of claim 19, wherein the folder is supported on at least one of said rails by dual linear bearings.

* * * * *